United States Patent [19]

Brown et al.

[11] Patent Number: 4,656,484

[45] Date of Patent: Apr. 7, 1987

[54] RADAR REFLECTOR AND SCANNER WITH ELECTROMAGNETIC PROGRAMMABLE DRIVE

[75] Inventors: Ralph A. Brown, Bountiful; Gerald H. Piele, Salt Lake City, both of Utah

[73] Assignee: Sperry Corporation, Blue Bell, Pa.

[21] Appl. No.: 762,415

[22] Filed: Aug. 5, 1985

[51] Int. Cl.[4] ..... H01Q 3/01; H01Q 3/12

[52] U.S. Cl. ..... 343/761; 343/840; 343/914

[58] Field of Search ..... 343/757, 766, 765, 763, 343/914, 915, 761, 839, 840, 880, 882; 350/607, 608, 611

[56] References Cited

U.S. PATENT DOCUMENTS

| | | | |
|---|---|---|---|
| 2,408,373 | 10/1946 | Chu | 343/839 |
| 2,570,197 | 10/1951 | Bohnert et al. | 343/839 |
| 2,585,579 | 2/1952 | Norden | 343/766 |
| 2,597,339 | 5/1952 | Krutter | 343/915 |
| 2,643,338 | 6/1953 | Brady | 343/763 |
| 3,882,503 | 5/1975 | Gamara | 343/915 |
| 4,041,500 | 8/1977 | Lapp | 343/766 |
| 4,046,462 | 9/1977 | Fletcher et al. | 350/608 |

FOREIGN PATENT DOCUMENTS

| | | | |
|---|---|---|---|
| 0159709 | 1/1933 | Switzerland | 350/608 |
| 380473 | 9/1932 | United Kingdom | 350/608 |

OTHER PUBLICATIONS

Payne, J. M., "Switching Subreflector for Millimeter Wave Radio Astronomy", Rev. Sci. Instrum., vol. 47, No. 2, Feb. 1976, pp. 222–223.

*Primary Examiner*—Charles Frankfort
*Assistant Examiner*—Thomas B. Will
*Attorney, Agent, or Firm*—G. Donald Weber, Jr.; Glenn W. Bowen

[57] ABSTRACT

Elements of a radar antenna are provided with one or more electromagnetic actuators capable of moving the elements (scanner or parabolic reflector), independently of the support system in response to electrical signals applied to the coils of the electromagnetic actuators.

7 Claims, 4 Drawing Figures

RADAR REFLECTOR AND SCANNER WITH ELECTROMAGNETIC PROGRAMMABLE DRIVE

BACKGROUND

1. Field of the Invention

This invention is directed to radar systems, in particular, and to a new and unique method and apparatus for selectively moving and/or repositioning a portion of the system thereby to direct the radar beam generated thereby, in particular.

2. Prior Art

There are many known devices and systems which are used in the provision of signals for scanning and/or tracking purposes. These systems are frequently referred to as radar systems. In the known systems, an electromagnetic signal is produced by an antenna and then focused and directed by appropriate dishes which take the form of parabolic reflectors, splash plates, or the like. Most of these existing systems are quite heavy, especially those devices used in ground installations. In airborne installations or the like, the support-structure is somewhat smaller but the antenna is likewise smaller. In operation, the basic concept of the radar scanner system is to provide an electromagnetic signal at the antenna. By scanning the antenna by means of a mechanical drive, the appropriate scanning operation can be effected. This scanning usually takes the form of rotation or nutation of the apparatus about the various axes so that the scan pattern can be controlled.

In an alternative embodiment, the scanner splash plate can be driven, in a suitable fashion, to rotate or oscillate about its axis in conjunction with the reflector plate. This rotation can take place independent of or in conjunction with the rotation of the reflector.

In the existing systems, some of which are described above, it is necessary to provide suitable electric motors which can drive the respective splash plate and/or reflector through gear trains or the like. These motors must be sufficiently accurately prepared and produced so as to provide the desired driving pattern to the reflector and/or the splash plate. Clearly, elaborate drive trains, bearing arrangements and the like are required.

Moreover, because each of the elements can be driven as discussed, the respective reflector and/or splash plate must be fabricated of a sufficiently sturdy and rugged material so as to withstand the mechanical forces, torque and the like which can be applied thereto. Moreover, a suitable framework must also be provided which can withstand these same forces.

As a consequence, the existing radar systems become relatively large, heavy, and cumbersome in order to operate in a reasonably reliable fashion. However, these same characteristics tend to make the systems bulky and unwieldy for many operations and proposed utilizations. Moreover, the existing systems tend to be quite expensive to fabricate and produce.

SUMMARY OF THE INSTANT INVENTION

This invention is directed to a radar system wherein the scanning operation is provided by using one or more coils, magnets and electromagnets to cause a portion of the splash plate or the reflector of a radar system to be selectively displaced. By disposing the coils, magnets and/or electromagnets in appropriate locations on the radar scanning mechanisms, an appropriate and planned pattern of movement of the radar system components can be effected which can be altered rapidly. The ability to change scanning frequency and pattern rapidly can assist in avoiding jamming of radar signals.

By selectively displacing the radar system surfaces, the beam generated thereby can be selectively positioned. By using programmable control beams, exotic beam patterns can be generated by the system. The patterns can be essentially linear, conical, Lissajous figures, or the like.

In addition, a relatively lightweight antenna system can be generated. Thus, this concept can be readily adapted to airborne antenna systems.

DESCRIPTION OF A PREFERRED EMBODIMENT

Figure 1:
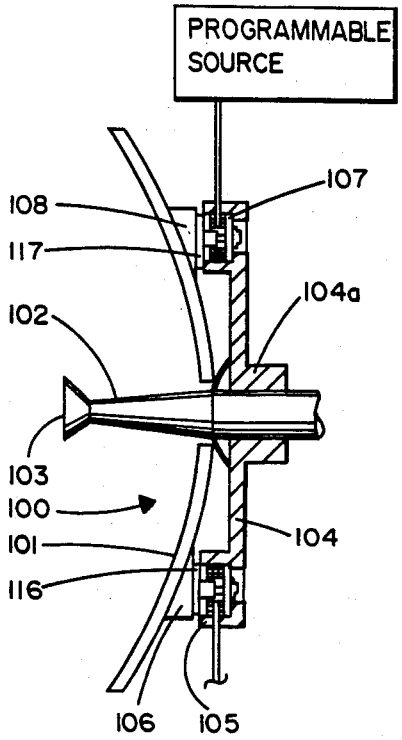
FIG. 1 is a schematic representation of a radar system in accordance with the instant invention.
Figure 2:
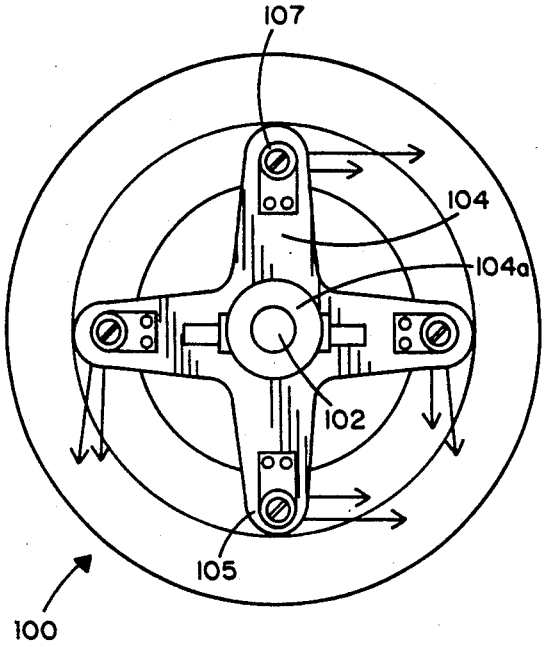
FIG. 2 is the back view of the system shown in FIG. 1 to illustrate mounting techniques.

Referring now to FIGS. 1 and 2, concurrently, there is shown a partially broken away, schematic, representation of a radar system in accordance with the instant invention. In this embodiment, a radar dish 100 includes a typical parabolic reflector 101. However, in this instance, the reflector can be prepared from a lightweight material which provides for low inertia. While not limited thereto, the reflector can be made of graphite fibers or the like. Of course, any other suitable lightweight low inertial material can be utilized. For example, a fiberglass dish with an appropriate reflectorized surface is feasible.

The standard fixed feed device 102 with a sub-reflector 103 is mounted to the radar system support mechanism (not shown) with a bolted flange or other means which enables the feed to be installed at a fixed location relative to the focal point of the reflector. This mounting can be adapted for selectively pointing the antenna in a particular direction in some embodiments. This mounting arrangement does not form a part on the invention, per se.

Mounted to the fixed feed unit 102 is the support bracket 104 which includes a hub 104A which is adapted to be mounted contiguous with the feed element 102. While the support bracket 104 is depicted in the form of a "spider", it can take the form of some other component having a plurality of support arms or the like. In the embodiment shown in FIG. 2, four such arms are shown. However, it should be understood that more (or fewer) arms may be utilized. In fact, if a large number of magnetic devices (described infra) are utilized, the support 104 can take the form of a circular plate or the like.

As seen in FIGS. 1 and 2, an electromagnetic device is mounted at the end of each of the bracket arms. As seen best in FIG. 1, an electromagnetic device 105 is mounted at the lower portion of support device 104 while another electromagnetic device 107 is mounted at the upper end of the support bracket 104. As shown in FIG. 1, the electromagnetic devices comprise a suitable coil, an armature and the like. This device is shown in greater detail hereafter.

Also mounted at selected locations on the reverse side of reflector 101 are appropriate magnetic devices 116 and 117. These magnetic devices can be mounted directly to reflector 101 or they can be mounted on appropriate shims 106 and 108, respectively. It is submitted that the shims permit additional flexibility and less restrictive tolerances in the arrangement and mounting of the magnetic devices 116 and 117 to the reflector 101. That is, the magnet (or magnetizable material) can be mounted on the shim material in order to provide adjustment of the tolerances between the magnet and the electromagnetic coil, and so forth. Conversely, the magnets can be mounted directly on the reverse side of the reflector 101. In this instance, the magnets 116 and 117 can be configured and contoured to match the configuration of reflector 101. Conversely, the magnets can be mounted directly on to the reverse side of the reflector 101 and the bracket 104 can be modified. For example, the ends of the bracket arms can be bent so that the electromagnet 105 or 107 is disposed in proper juxtaposition to the reflector. Of course, the positions can be reversed and the magnet can be mounted on the bracket 104 and the coil attached to the reflector 101.

Moreover, the magnet, magnetic material, or the electromagnetic coil can be formed in or as a part of the reflector 101. In like manner, it is conceivable that the reflector 101 or the bracket 104 can be fabricated of magnetic material itself, in some instances, provided the appropriate control can be maintained.

Figure 3:
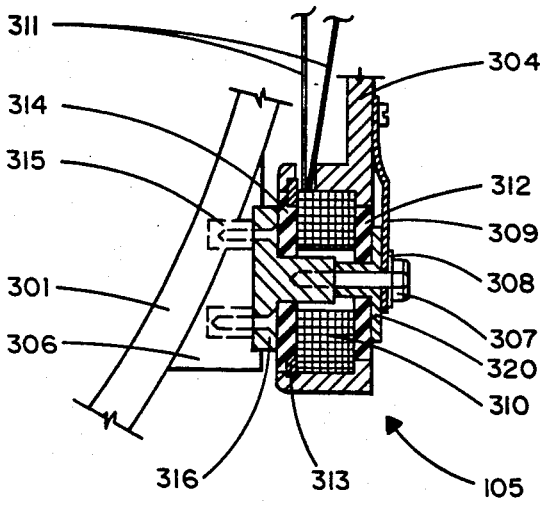
FIG. 3 is a more detailed showing of a portion of the invention shown in FIG. 1.

Referring now to FIG. 3, there is shown a more detailed illustration of one embodiment of the magnetic system apparatus. In this instance, a portion of the reflector 301 is shown. Mounted to the reflector is a suitable shim 306. The shim can be mounted to the reflector by means of mechanical fasteners such as rivets or the like. Conversely, the shim 306 can be mounted to reflector 301 by means of any suitable adhesive such as an epoxy or the like. Mounted on the surface of shim 306 by fastners 315 is a magnet or armature of suitable magnetic material 316. This material (for example, soft iron, alnico, samarium cobalt or the like) can be mounted to the shim 306 by a suitable fastening means such as screws, adhesives or the like. The shape of the armature is not limited by the designs shown and can include an elongated shaft of magnetic material.

Adjacent to this shim and magnetic strip is disposed an electromagnetic device 105. This device is mounted on the support bracket 304, a portion of which is shown. This apparatus includes an electromagnetic coil 310 which is wound about a suitable core or support. (Of course, the coil can be independently wound as well.) The wires 311 extend from the coil 310 for connection to any suitable electrical system to be described infra.

On opposite sides of the coil 310 are provided soft rubber washers 312 and 314. These rubber springs or washers which can be of any suitable flexible material or thickness, are used to allow the armature 316 to deflect when the magnetic coil 310 is activated. In addition, the soft rubber springs 312 and 314 serve to shield the coil from dirt and moisture.

The coil and rubber springs are mounted to bracket 304 by means of a appropriate mounting apparatus which includes, for example, bolt 307 and washer 308. The bolt 307 is threadedly attached to the magnet armature 316 which is centrally located relative to coil 310. This armature 316 can be a permanent magnet which is selectively moved relative to the coil 310. Conversely, the magnet 316 can be a piece of magnetizable material which is selectively energized and magnetized by the activation of coil 310.

A position control flexure device 309 is used to center the magnet within the coil. The snap ring 313 retains the coil 310 within the bracket housing. A non-magnetic washer 320 is held in place by bolt 307 to clamp the coil apparatus together.

In like manner, a clamp sleeve 309 is provided as well. This sleeve is, preferably, fabricated of non-magnetic material and serves to hold the assembly together.

Thus, in operation, an activation signal is selectively supplied, via wires 311, to the coil 310. Activation of the coil operates to energize the electromagnetic apparatus, in a similar fashion to a speaker coil, and to effectively reposition (i.e. move) the reflector 301 (or reflector 101 in FIG. 1). That is, the armature is moved in response to the coil activation. Thus, the reflector is, effectively, repositioned relative to the electromagnetic beam which is applied by the feed device 102. Repositioning of the reflector, thus, has the effect of relocating or redirecting the beam produced by the radar system.

By means of selectively activating different coils and the intended electromagnetic apparatus, is seen (see especially FIG. 1) that controlled deformation of the reflector 101 can be achieved. This controlled deformation can have the effect of controlling the positioning and direction of the beam produced by the radar system.

The coils can be operated in an attract mode which will move the reflector toward the apparatus including the mounting bracket. Conversely, a repelling operation can be produced. Likewise, it is clear that a push-pull operation can be achieved. This would permit the deformation of the reflector to be increased to a larger degree while requiring only a relatively small change in position or movement. Likewise, by pulling on one magnet (e.g. device 107) and pushing on the opposite magnet (e.g. device 105), an exaggerated deformation or deflection of the reflector can be achieved.

In addition, by utilizing a plurality of the magnetic apparatuses, (see for example FIG. 2) a circular movement or deflection of the reflector can be achieved. This deflection can be likened or considered to be a circular, wave-like motion in the reflector. Also, by appropriate control of the sequence of activation of the electromagnetic devices, horizontal sweeping, vertical sweeping, circular sweeping or any combination thereof can be achieved.

Although not shown, per se, it is understood that the electromagnets can be driven by any suitable power source which is connected to the wires 311 associated with the respective electromagnetic devices. Thus, a pattern can be stored in a suitable memory, such as a semiconductor memory, a tape drive, a disk drive or the like. This pattern can be used to appropriately activate the various magnetic apparatuses. Thus, the same pattern can be repetitively performed by a particular antenna system. Moreover, the same pattern can be applied to a plurality of antennas so that an entire bank of antennas can be performing the same pattern in a coordinated fashion, i.e. together or in a desired and correlated sequence.

Figure 4:
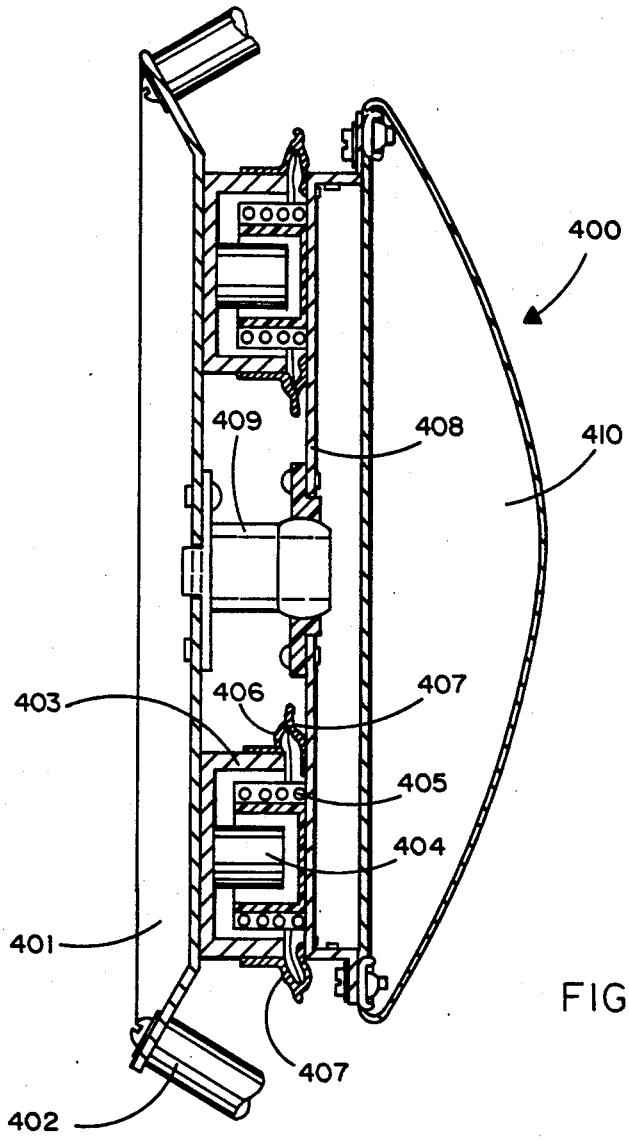
FIG. 4 is a schematic representation of another embodiment of the instant invention.

Referring now to FIG. 4, there is shown another embodiment of the invention. In this embodiment, the splash plate 410 is mounted to the reflector (such as reflector 101 in FIG. 1) by means of suitable and standard mounting struts 402. The struts 402 are mounted directly to the support plate 401 to which is mounted the support bearing 409. The support bearing 409 is mounted to the drive mechanism by means of bolts, rivets, welds or other suitable technique.

In this embodiment, the magnets 404 are mounted to the support plate 401 by any suitable means. In the embodiment shown, the magnets 404 are mounted in a supporting cup 403 which is fabricated of any suitable material such as soft iron which has the preferred magnetic characteristics.

In addition, the mounting bracket 408 is attached to the splash plate 410 by suitable means such as nuts and bolts. The support plate 408 is also pivoted on the support bearing 409 to allow the splash plate to tilt (or pivot) in response to the action of the magnets.

A suitable bellows 407 and 406 are provided to permit enclosure of the cup 403 and the magnet 404 as well as the coil 405. The bellows permits flexure for movement of the support plate 408 (and thus splash plate 410) when the electromagnet device comprising the magnet 404 and the coil 405 are selectively activated. Also, the bellows operates to keep dirt out of the magnetic apparatus.

Again, it is seen that any pattern of electromagnetic devices can be prepared and mounted on the support 401 and the flexure plate 408. These electromagnetic devices can be controlled in the same fashion as the electromagnetic devices shown and described relative to FIGS. 1 through 3. As a consequence, the splash plate 410 can be selectively positioned in the same fashion.

In the instance where the splash plate is selectively activated, it is possible to maintain a stationary reflector 101 with the splash plate providing the moving beam which is reflected from the stationary reflector to produce whatever pattern is desired. Conversely, the splash plate may be maintained stationary and the reflector can be selectively moved as described above. Of course, it is possible that both the splash plate and the reflector can be selectively moved in order to establish a complex beam pattern if so desired.

The type of beam and pattern therefor is not a limiting factor in this invention. Rather, the beam and its configuration, as defined by the user, is determined by the number, size and positioning of the various electromagnetic devices.

Thus, there is shown and described a new and unique radar system with an electromagnetic drive which selectively controls the position of the beam which is prepared and generated by the system. The system uses electromagnetic drives to control the positioning of the splash plate or reflector. However, only portions of the splash plate or reflector need be controlled at any time. With this arrangement, the heavy duty bearings, drive trains, and support structure of existing radar systems can be eliminated.

It is to be understood that this description is directed to preferred embodiments. The number of electromagnetic drives, the type of materials, specific mountings and so forth are subject to modification and rearrangement. Those skilled in this art may conceive of modifications or arrangements which are not specifically shown herein. Any such modifications or arrangements which fall within the purview of this description are intended to be included therein as well even if not specifically stated. It is clear that this description is not intended to be limitative of the invention. Rather the scope of the invention is limited only by the claims appended hereto.

We claim:

1. An improved radar scanner comprising, a signal source for producing an electromagnetic signal, reflector means for reflecting said electromagnetic signal produced by said signal source so as to produce a beam pattern, said reflector means comprising a unitary disk-like element having a substantially parabolic curvature and formed of a flexible reflective material, at least one magnetic element associated with said releector means, each said magnetic element comprises an electromagnet which includes a coil which is selectively activated by the application of an electrical signal thereto and an armature which is adapted to be moved when said coil is activated thereby to selectively displace a portion of said reflector means in order to selectively alter the curvature of said reflector means thereby to alter the angle of reflection of said electromagnetic signal and modify said beam pattern, support means mounted to said reflector means and arranged to support each said magnetic element, and control means connected to said coil to supply electrical signals thereto in a prescribed pattern thereby to control the operation of each said magnetic element.

2. The scanner recited in claim 1 wherein, said armature is attached to said relector means.

3. The scanner recited in claim 1 wherein, said reflector means comprises a splash plate in a radar system.

4. The scanner recited in claim 1 wherein, said reflector means comprises the reflector dish in a radar system.

5. The scanner recited in claim 1 wherein, said support means supports a plurality of magnetic elements.

6. The scanner recited in claim 1 wherein, said magnetic element is formed within said reflector means.

7. The scanner recited in claim 1 wherein, said magnetic element is mounted to said reflector means.

* * * * *